US011524502B2

(12) United States Patent
Ikegame

(10) Patent No.: US 11,524,502 B2
(45) Date of Patent: Dec. 13, 2022

(54) LIQUID STORAGE PACK

(71) Applicant: CANON KABUSHIKI KAISHA, Tokyo (JP)

(72) Inventor: Ken Ikegame, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 17/185,157

(22) Filed: Feb. 25, 2021

(65) Prior Publication Data

US 2021/0268802 A1 Sep. 2, 2021

(30) Foreign Application Priority Data

Feb. 28, 2020 (JP) ..... JP2020-033479

(51) Int. Cl.
*B41J 2/175* (2006.01)

(52) U.S. Cl.
CPC ..... *B41J 2/17513* (2013.01); *B41J 2/17553* (2013.01); *B41J 2002/17516* (2013.01)

(58) Field of Classification Search
CPC ..... B41J 2/17513; B41J 2/17553; B41J 2002/17516; B41J 2/1753
USPC ..... 347/86
See application file for complete search history.

(56) References Cited

U.S. PATENT DOCUMENTS

| | | | | |
|---|---|---|---|---|
| 10,343,412 | B2 | 7/2019 | Kawate et al. | B41J 2/17523 |
| 2005/0179751 | A1* | 8/2005 | Seino | B41J 2/17559 347/86 |
| 2017/0173966 | A1* | 6/2017 | Kawate | B41J 2/17506 |
| 2018/0104955 | A1* | 4/2018 | Kawate | B41J 29/13 |

FOREIGN PATENT DOCUMENTS

JP 2018-065373 4/2018

* cited by examiner

*Primary Examiner* — Kristal Feggins
*Assistant Examiner* — Alexander D Shenderov
(74) *Attorney, Agent, or Firm* — Venable LLP

(57) ABSTRACT

Provided is a liquid storage pack including: a flat flexible bag member storing a liquid to be supplied to a liquid ejection apparatus; and a spacer member provided inside the bag member. The spacer member has an outer shape that is symmetrical with respect to a predetermined reference plane, and is disposed such that, in a state where the bag member is fully filled with the liquid, the reference plane is offset from a center plane of the bag member in a thickness direction of the bag member, the center plane passing a center of the bag member in the thickness direction and being perpendicular to the thickness direction. This liquid storage pack can stably supply the liquid therein at a uniform concentration.

16 Claims, 8 Drawing Sheets

LIQUID STORAGE PACK

BACKGROUND OF THE INVENTION

Field of the Invention

The present invention relates to a liquid storage pack.

Description of the Related Art

There are liquid ejection apparatuses such as inkjet recording apparatuses that include a liquid storage pack storing a liquid such as an ink in a flat bag member having flexibility. Such a liquid storage pack is required to stably supply the liquid to the liquid ejection apparatus even after the flexible bag member shrinks with consumption of the liquid. Japanese Patent Application Laid-Open No. 2018-65373 discloses a liquid storage pack that prevents closure of a flow path inside its bag member by providing a spacer member inside the bag member.

However, with the liquid storage pack disclosed in Japanese Patent Application Laid-Open No. 2018-65373, there is a possibility that unintended bends may be formed on the bag member, in particular at a portion under the spacer member and end portions as the shrinkage of the bag member progresses. As a consequence, a high-concentration liquid containing a large amount of a settling component may remain unused at the bent portions of the bag member, thus making the concentration of the liquid to be supplied to the liquid ejection apparatus not uniform.

It is therefore an object of the present invention to provide a liquid storage pack capable of stably suppling a liquid at a uniform concentration regardless of the remaining amount of the liquid.

SUMMARY OF THE INVENTION

In order to achieve the above object, a liquid storage pack of the present invention includes: a flat flexible bag member storing a liquid to be supplied to a liquid ejection apparatus; and a spacer member provided inside the bag member. The spacer member has an outer shape that is symmetrical with respect to a predetermined reference plane, and is disposed such that, in a state where the bag member is fully filled with the liquid, the reference plane is offset from a center plane of the bag member in a thickness direction of the bag member, the center plane passing a center of the bag member in the thickness direction and being perpendicular to the thickness direction.

Further features of the present invention will become apparent from the following description of exemplary embodiments with reference to the attached drawings.

DESCRIPTION OF THE EMBODIMENTS

Embodiments of the present invention will be described below with reference to the drawings. The description will be given herein by taking as an example a case where a liquid storage pack of the present invention stores an ink (liquid) to be supplied to an inkjet recording apparatus (liquid ejection apparatus). However, the application of the liquid storage pack is not limited to this case. The liquid storage pack of the present invention is applicable to various types of liquid ejection apparatuses that eject liquids other than inks, for example. Note that the "liquids" here include not only materials in a liquid phase but also particles of a solid functional material, such as pigments and metal particles, dissolved, dispersed, or mixed in a solvent and the like. Representative examples of such include liquid crystals and so on as well as inks. Also, the "inks" here are pigments as settling components dispersed in a solvent, and include various liquid compositions such as gel inks and hot melt inks as well as general water-based inks and oil-based ink.

Figure 1:
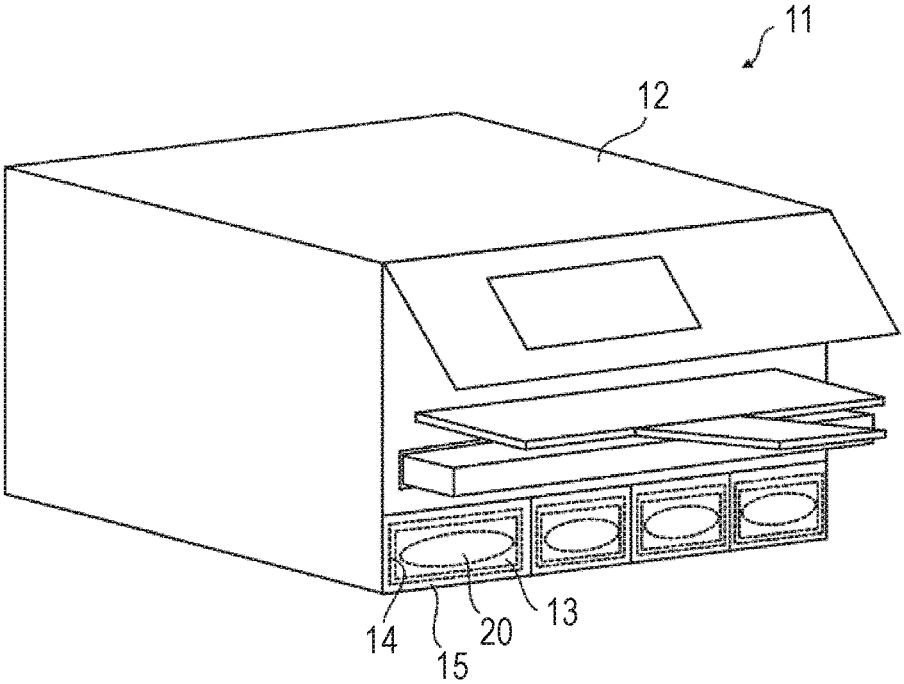
FIG. 1 is a perspective view of a liquid ejection apparatus using a liquid storage pack of the present invention.

FIG. 1 is a perspective view of the liquid ejection apparatus using the liquid storage pack of the present invention.

A liquid ejection apparatus 11 is an inkjet recording apparatus that has a rectangular parallelepiped housing 12 and a liquid ejection head (not illustrated) provided inside the housing 12, and records an image on a recording medium (not illustrated) by ejecting an ink(s) as a liquid(s) from the liquid ejection head. The liquid ejection head may be a serial head that moves reciprocally in a direction crossing the direction of conveyance of the recording medium or a line head that does not move reciprocally but is fixed to the body of the apparatus.

The liquid ejection apparatus 11 also has a liquid storage pack 20 storing the liquid to be supplied to the liquid ejection head, and a case 13 housing the liquid storage pack 20 in a detachable manner. The case 13 with the liquid storage pack 20 housed therein is inserted into a mounting section 14 opening at the front surface of the housing 12 to be mounted in a detachable manner. Note that the case 13 can be mounted in the mounting section 14 alone without the liquid storage pack 20 housed therein. A plurality (four in the illustrated example) of the mounting sections 14 are provided side by side in the width direction of the housing 12. At the opening of each mounting section 14, a cover 15 to cover the mounting section 14 is provided so as to be openable and closable.

First Embodiment

Figure 2A:
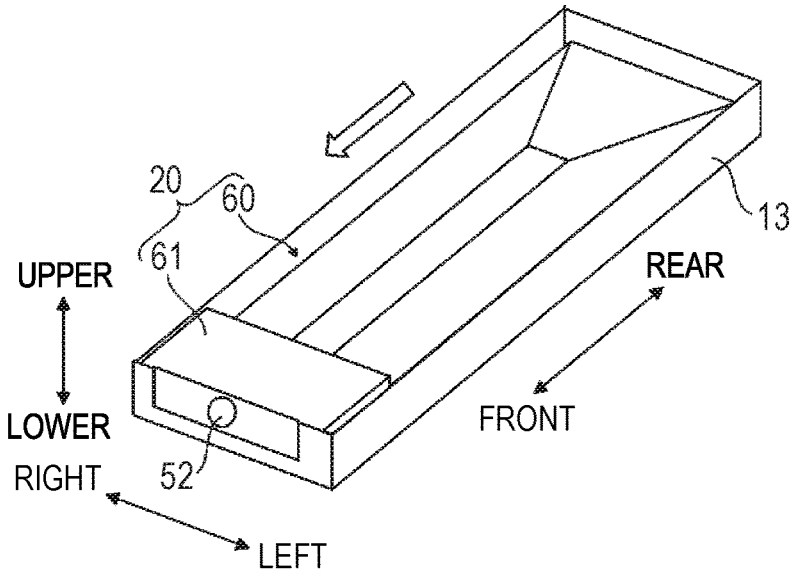
FIGS. 2A and 2B are perspective views of a liquid storage pack and a case according to a first embodiment.
Figure 2B:
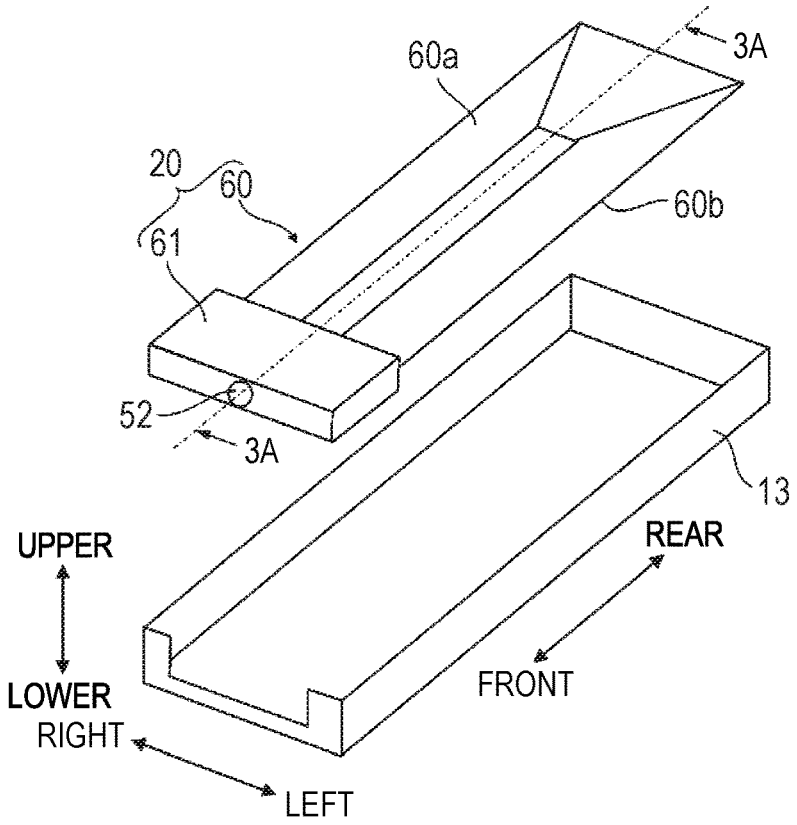

FIGS. 2A and 2B are perspective views of a liquid storage pack and a case according to a first embodiment of the present invention. FIG. 2A illustrates a state where the liquid storage pack is housed in the case, and FIG. 2B illustrates a state where the liquid storage pack is taken out of the case.

A liquid storage pack 20 has a flat flexible bag member 60 storing a liquid and an adapter 61, and is housed in a rectangular parallelepiped case 13 opening at its top such that one surface of the bag member 60 faces the bottom surface of the case 13. Note that, in the following description, for convenience, the downstream side and the upstream side of the liquid storage pack 20 in the direction along the long edges of the case 13 in which the case 13 is mounted into the liquid ejection apparatus 11 (see the outlined arrow in FIG. 2A) will be expressed as "front" and "rear", respectively. Moreover, the left side and the right side in the transverse direction in a view in the mounting direction (the direction along the short edges of the case 13) will be expressed as "left" and "right", respectively, and the upper side and the lower side in the vertical direction (the thickness direction of the bag member 60) in a state where the liquid storage pack 20 is placed on a horizontal surface will be expressed as "upper" and "lower", respectively.

The bag member 60 includes two rectangular films 60*a* and 60*b* and is a pillow-type bag formed by joining peripheral edge portions of the two films 60*a* and 60*b* placed one over the other. The adapter 61 is to connect the liquid storage pack 20 to the liquid ejection apparatus 11, and is attached to a front end portion of the bag member 60. The liquid stored in the bag member 60 is introduced to the liquid ejection apparatus 11 through a liquid supplying section 52 exposed at the front surface of the adapter 61.

The films 60*a* and 60*b* forming the bag member 60 is made of a material having flexibility and gas barrier properties. Examples of such a material include polyethylene terephthalate (PET), nylon, polyethylene, and so on. The films 60*a* and 60*b* forming the bag member 60 may each be a laminate film formed of a plurality of layers. For example, the outer layer may be made of PET or nylon, which has good shock resistance, and the inner layer may be made of polyethylene, which has good ink resistance. Further, one of the plurality of layers may be a layer obtained by vapor deposition of aluminum or the like.

Figure 3A:
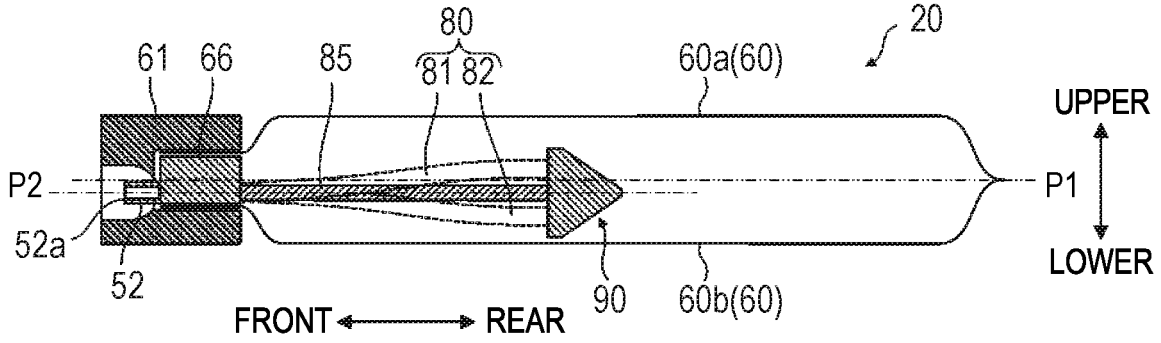
FIGS. 3A and 3B are a cross-sectional view and a front view of the liquid storage pack according to the first embodiment.
Figure 3B:
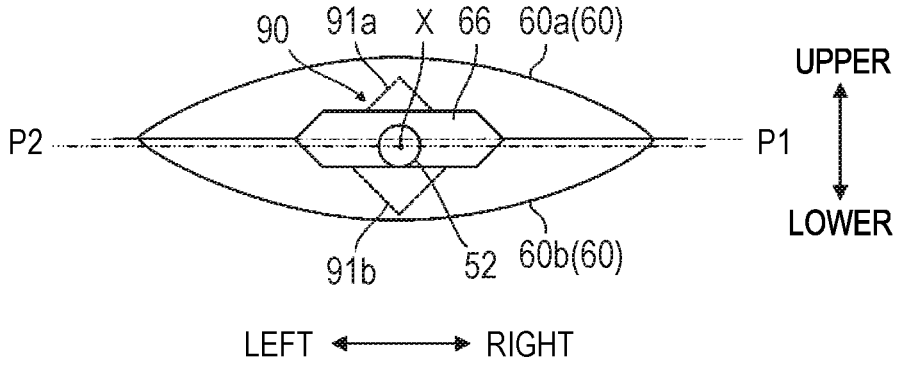

FIG. 3A is a cross-sectional view taken along the line 3A-3A of FIG. 2B, illustrating the liquid storage pack in this embodiment. FIG. 3B is a front view of the bag member in this embodiment as seen from the front side. Note that FIGS. 3A and 3B illustrate a state where the bag member 60 is fully filled with the liquid before the liquid storage pack 20 is used.

The liquid storage pack 20 has a flow path forming member 66 joined to a front end portion of the bag member 60, a spacer member 90 provided inside the bag member 60, and a rod-shaped linker member 85 linking the flow path forming member 66 and the spacer member 90 to each other. The flow path forming member 66 has the cylindrical liquid supplying section 52, which is integrated with the flow path forming member 66 and has a supply port 52*a* for supplying the liquid to the liquid ejection apparatus 11, and also has a flow path (not illustrated) therein which communicates with the supply port 52*a*. The flow path inside the flow path forming member 66 communicates with two liquid intake ports 92 and 93 (see FIG. 4C) formed in the spacer member 90 through a liquid introducing section 80 including two liquid introduction pipes 81 and 82. The flow path forming member 66 has a shape that is asymmetrical with respect to a center axis X of the supply port 52*a* in the vertical direction. In this way, when the flow path forming member 66 is joined between the two films 60*a* and 60*b*, the center axis X of the supply port 52*a* is offset downward from a center plane P1 of the bag member 60 fully filled with the liquid, the center plane P1 passing the center of the bag member 60 in the thickness direction (vertical direction) and being perpendicular to the thickness direction. Here, "downward" indicates a direction toward a side lower than the center plane P1 in the direction indicated by the up-and-downward arrows in FIGS. 3A and 3B. Alternatively, "downward" can be expressed as, for example, a direction from the center plane P1 toward the bottom surface of the case 13 housing the liquid storage pack 20 in FIGS. 2A and 2B. Still alternatively, "downward" can be expressed as a direction toward a side lower than the center plane P1 in the direction of gravity in a state where the liquid storage pack 20 housed in the case 13 is mounted in the liquid ejection apparatus 11. Note that the shape of the flow path forming member 66 may be another shape as long as the center axis X of the supply port 52*a* is offset from the center plane P1 of the bag member 60 when the flow path forming member 66 is joined to the bag member 60.

The spacer member 90 is to secure a certain volume inside the bag member 60, and is made of a synthetic resin such as polyethylene or polypropylene, for example. Though details will be described later, the spacer member 90 has an outer shape formed of an upper surface 91*a* and a lower surface 91*b* that are symmetrical to each other with respect to a predetermined reference plane P2. In addition, the spacer member 90 is supported by the flow path forming member 66 such that the reference plane P2 is parallel to the center plane P1 of the bag member 60 and the center axis X of the supply port 52*a* of the flow path forming member 66 is located on a plane including the reference plane P2 (hereinafter also referred to simply as "reference plane"). In other words, the spacer member 90 is disposed such that, in the state where the bag member 60 is fully filled with the liquid, the plane-symmetric reference plane P2 is offset downward from the center plane P1 of the bag member 60. An advantageous effect of such arrangement of the spacer member 90 will be described later.

Note that the "outer shape" here is a concept including not only shapes formed by flat or smooth surfaces but also shapes formed by surfaces in which grooves, concavities, or the like are formed, surfaces on which protrusions or convexities are formed, or imaginary surfaces surrounded by a frame. This means that as long as the surfaces forming the "outer shape" can be figured out as a whole, concavities, convexities, and/or through-holes may be formed in certain regions occupied by these surfaces. Also, the linker member 85 may be omitted, and the spacer member 90 may be directly fixed to the flow path forming member 66.

Figure 4A:
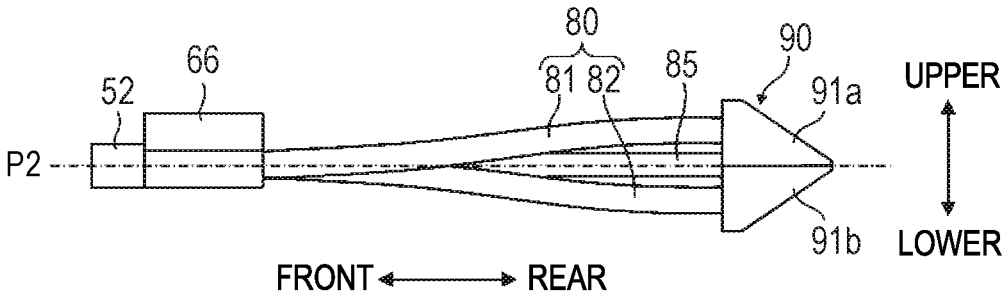
FIGS. 4A, 4B, and 4C are views illustrating a configuration inside a bag member according to the first embodiment.
Figure 4B:
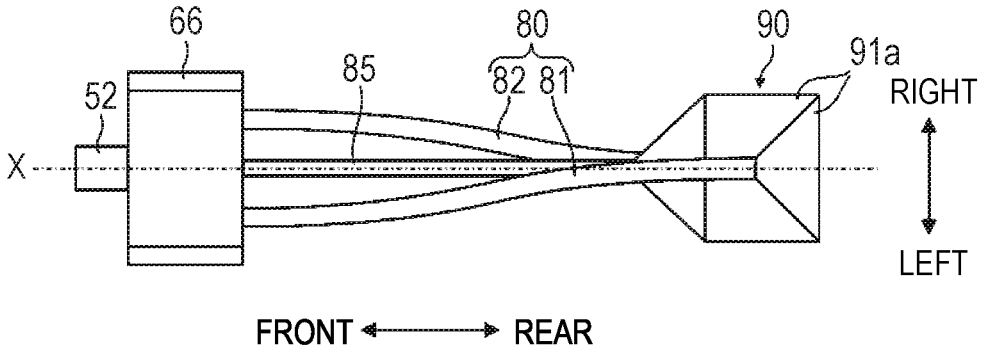
Figure 4C:
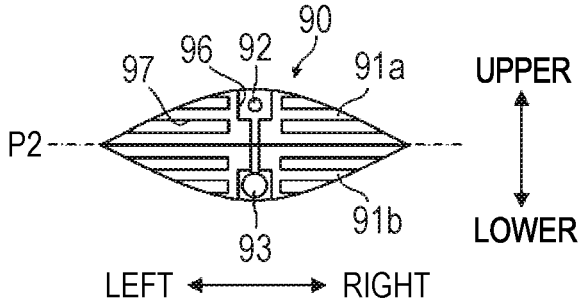

FIGS. 4A and 4B are a side view and a plan view illustrating a configuration inside the bag member, respectively, and FIG. 4C is a front view of the spacer member as seen from the rear side.

As described above, the spacer member 90 has the upper surface 91*a* and the lower surface 91*b*, which are symmetrical to each other with respect to the reference plane P2. The upper surface 91*a* is formed of three inclined surfaces facing obliquely upward toward the rear, obliquely upward toward the left, and obliquely upward toward the right, respectively. The lower surface 91*b* is also formed of three inclined surfaces facing obliquely downward toward the rear, obliquely downward toward the left, and obliquely downward toward the right, respectively. The upper surface 91*a* and the lower surface 91*b* are formed such that the thickness (the length in the vertical direction) of the spacer member 90 decreases from the front side to the rear side. The spacer member 90 therefore has a shape that becomes sharper toward the rear side when seen from the transverse direction (see FIG. 4A). Also, the upper surface 91*a* and the lower surface 91*b* are formed such that the thickness of the spacer member 90 decreases from the center toward either end in the transverse direction when seen from the longitudinal direction (see FIG. 4C). Incidentally, as illustrated in FIG. 4B, the upper surface 91*a* and the lower surface 91*b* of the spacer member 90 are formed to be symmetrical to each other also with respect to a plane including the center axis X of the supply port 52*a* of the flow path forming member 66 and being perpendicular to the reference plane P2.

Also, in the spacer member 90, the two liquid intake ports 92 and 93 are formed, each of which opens toward the rear side. The first liquid intake port 92 is formed in a region higher than the reference plane P2 in order to take in the liquid present on a relatively upper side inside the bag member 60. The second liquid intake port 93 is formed on the opposite side of the reference plane P2 from the first liquid intake port 92, i.e., a region lower than the reference plane P2, in order to take in the liquid present on a relatively lower side inside the bag member 60. In the upper surface 91*a* and the lower surface 91*b* of the spacer member 90 are formed a vertical groove 96 communicating with the liquid intake ports 92 and 93 and horizontal grooves 97 communicating with the vertical groove 96. The vertical groove 96 and the horizontal grooves 97 form flow paths through which the liquid flows toward the liquid intake ports 92 and 93.

The liquid introducing section 80 has the two liquid introduction pipes 81 and 82 each being an elastic tube made of an elastomer, for example. In this embodiment, the two liquid introduction pipes 81 and 82 have the same length and are connected at their front end portions to the flow path forming member 66 and connected at their rear end portions to the spacer member 90. The first liquid introduction pipe 81 communicates at its front end portion with the flow path inside the flow path forming member 66 and communicates at its rear end portion with the first liquid intake port 92. The second liquid introduction pipe 82 communicates at its front end portion with the flow path inside the flow path forming member 66 and communicates at its rear end portion with the second liquid intake port 93.

With these configurations of the spacer member 90 and the liquid introducing section 80, the flow path inside the bag member 60 is less likely to be closed even when the shrinkage of the bag member 60 progresses with consumption of the liquid. This can reduce the possibility of failing to stably supply the liquid to the liquid ejection apparatus 11. Incidentally, a low-concentration liquid is taken in from the first liquid intake port 92 and a high-concentration liquid is taken in from the second liquid intake port 93, and these are mixed with each other inside the flow path forming member 66 and supplied to the liquid ejection apparatus 11. Here, the liquids taken in are caused to transition from a state of flowing through the first and second liquid introduction pipes 81 and 82 side by side in the vertical direction to a state of flowing side by side in the horizontal direction, and are then mixed with each other inside the flow path forming member 66. Accordingly, the concentration of the liquid to be supplied to the liquid ejection apparatus 11 can be more stable.

Note that the arrangement of the first and second liquid introduction pipes 81 and 82 is not limited to the one in which their rear end portions are disposed side by side in the vertical direction and their front end portions are disposed side by side in the transverse direction. The arrangement may be such that not only the rear end portions but also the front end portions are disposed side by side in the vertical direction. Also, the sizes (aperture diameters) of the first liquid intake port 92 and the second liquid intake port 93 are not particularly limited. Suitable sizes can be selected according to the state of the settling component in the liquid. However, in view of the fact that facilitating suction of a high-concentration liquid containing a larger amount of the settling component enables supply of a liquid at a concentration close to the original concentration, it is preferable that the aperture diameter of the second liquid intake port 93 be larger than the aperture diameter of the first liquid intake port 92. Moreover, the number of liquid introduction pipes forming the liquid introducing section 80 is not limited to two and may be three or more. On the other hand, in the case where the linker member 85 is omitted and the spacer member 90 is directly fixed to the flow path forming member 66, the liquid introducing section 80 may be omitted as well.

Meanwhile, the bag member 60 shrinks with consumption of the liquid. Where and how the shrinkage occurs vary depending on the position of the spacer member 90 inside the bag member 60. For this reason, unintended bends may be formed on the bag member 60 in some cases. For example, if the reference plane P2 of the spacer member 90 is present at a position coinciding with the center plane P1 of the bag member 60 or a position offset upward from the center plane P1, unfavorable bends may be formed at a portion under the spacer member 90 and end portions. That is, a high-concentration liquid containing a larger amount of the settling component may remain unused at the bent portions as above, thus making the concentration of the liquid to be supplied to the liquid ejection apparatus 11 not uniform.

Figure 5A:
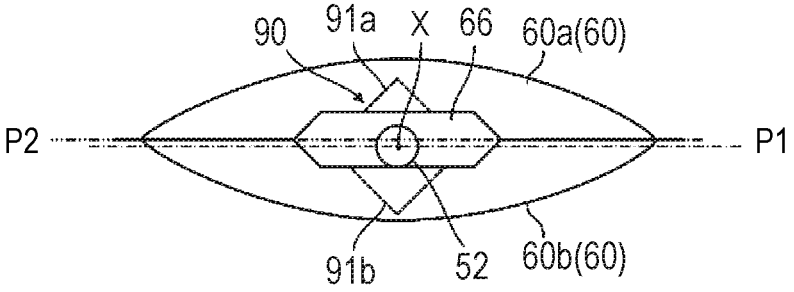
FIGS. 5A, 5B, 5C, and 5D are front views illustrating changes in the state of the bag member corresponding to remaining amounts of a liquid.
Figure 5B:
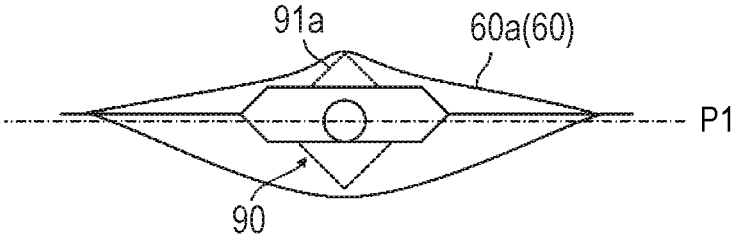
Figure 5C:
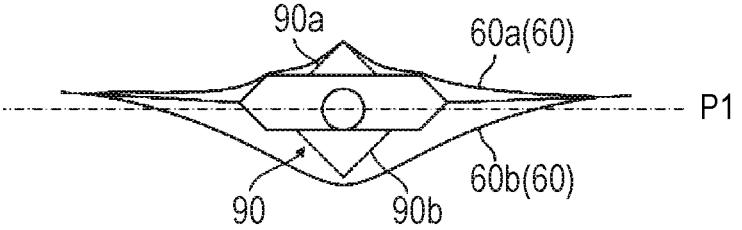
Figure 5D:
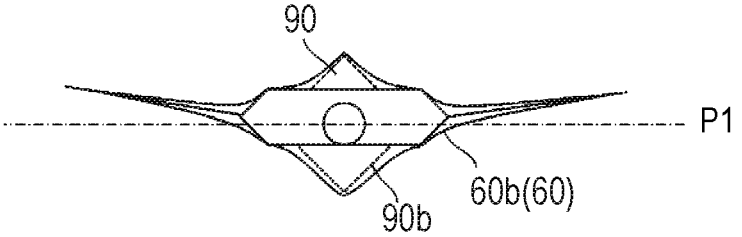

To solve this, the spacer member 90 in this embodiment is disposed such that, in the state where the bag member 60 is fully filled with the liquid, the plane-symmetric reference plane P2 is offset downward from the center plane P1 of the bag member 60, as described above. This makes it possible to prevent the formation of unintended bends on the bag member 60 with shrinkage of the bag member 60. Such an advantageous effect achieved by the spacer member 90 will be described below with reference to FIGS. 5A to 5D. FIGS. 5A to 5D are front views illustrating changes in the state of the bag member corresponding to remaining amounts of the liquid as seen from the front side. FIG. 5A illustrates a state where before use, in which the remaining amount of the liquid is largest (the bag member is fully filled with the liquid). FIG. 5D illustrates a state after use in which the remaining amount of the liquid is smallest.

In the state before use illustrated in FIG. 5A, the inner surface of the bag member 60 is in contact with neither the upper end nor the lower end of the spacer member 90. As the liquid is consumed from this state, the bag member 60 collapses such that the inner surface of the upper film 60*a* firstly starts contacting the upper end of the spacer member 90, as illustrated in FIG. 5B. As the liquid is consumed further, the bag member 60 collapses with the inner surface of the upper film 60*a* in contact with the upper surface 91*a* of the spacer member 90. Then, the bag member 60 reaches a state where substantially the entire upper surface 91*a* of the spacer member 90 is in contact with the inner surface of the upper film 60*a*, as illustrated in FIG. 5C. In this state, the inner surface of the lower film 60*b* is not in contact with the entire lower surface 91*b* of the spacer member 90 since the liquid tends to accumulate in a lower region inside the bag member 60 due to the effect of gravity. Then, as the liquid is consumed until it is used up, the bag member 60 reaches a state where substantially the entire lower surface 91*b* of the spacer member 90 is in contact with the inner surface of the lower film 60*b*, as illustrated in FIG. 5D.

As described above, with the arrangement of the spacer member 90 in this embodiment, when the bag member 60 shrinks with consumption of the liquid, the bag member 60 can collapse while contacting the spacer member 90 without bending the lowermost portion of the lower film 60*b* or bending end portions in the transverse direction. Thus, as the shrinkage of the bag member 60 progresses, the end portions of the bag member 60 in the transverse direction always curve upward, thereby enabling a high-concentration liquid containing a larger amount of the settling component to be aggregated around the second liquid intake port 93 of the spacer member 90. This makes it possible to prevent the high-concentration liquid from remaining unused at a portion under the spacer member 90 and end portions in the bag member 60, and therefore supply the liquid at a uniform concentration to the liquid ejection apparatus 11 regardless of the remaining amount of the liquid inside the liquid storage pack 20.

Note that the spacer member 90 may be offset from the center plane P1 of the bag member 60 to any extent as long as the lower end of the spacer member 90 is not in contact with the inner surface of the lower film 60*b* when the bag member 60 is fully filled with the liquid. However, in light of the concentrations of the liquids to be taken in from the two liquid intake ports 92 and 93, it is preferable that the spacer member 90 not be offset to a great extent. Specifically, it is preferable that the spacer member 90 not be offset to such an extent that the first liquid intake port 92 is lower than the center plane P1 of the bag member 60. In other words, it is preferable that the spacer member 90 be offset to such an extent that the center plane P1 of the bag member 60 is located between the first liquid intake port 92 and the reference plane P2. Also, it is preferable that the bag member 60 be symmetrical with respect to the center plane P1 when fully filled with the liquid, but the shape of the bag member 60 is not limited to this shape.

Figure 6A:
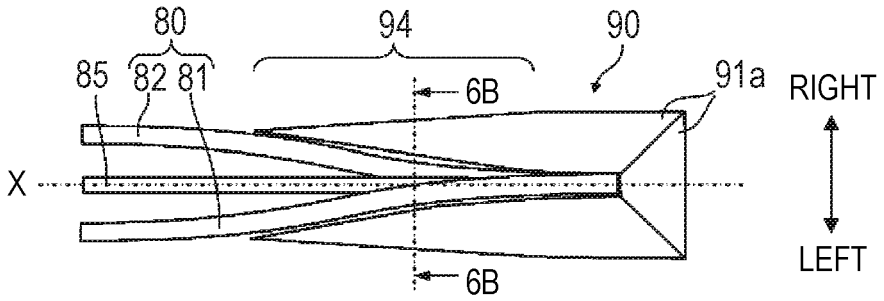
FIGS. 6A and 6B are views illustrating a modification of a spacer member according to the first embodiment.
Figure 6B:
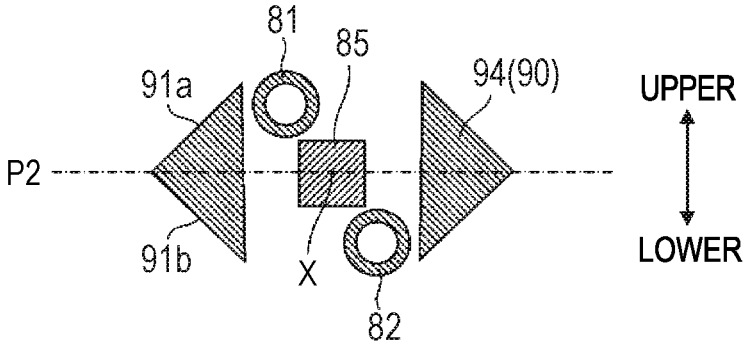
Figure 7A:
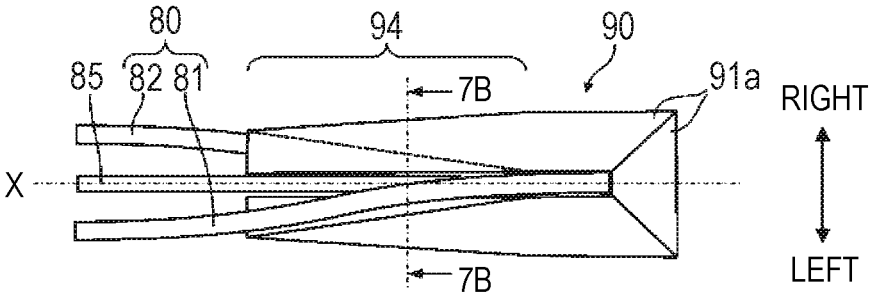
FIGS. 7A and 7B are views illustrating another modification of the spacer member according to the first embodiment.
Figure 7B:
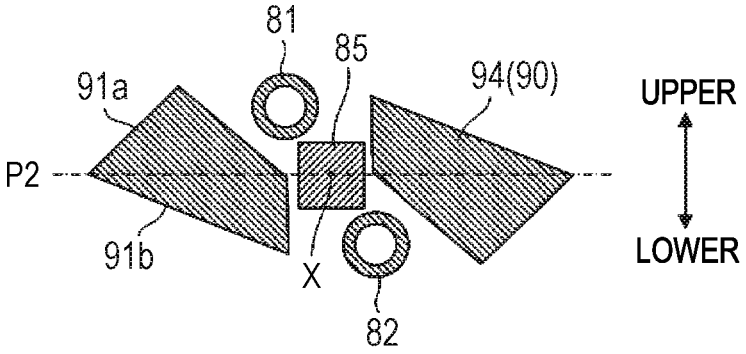

Modifications of the spacer member 90 in this embodiment will now be described with reference to FIGS. 6A and 6B and FIGS. 7A and 7B. FIG. 6A is a plan view illustrating a modification of the spacer member in this embodiment, and FIG. 6B is a cross-sectional view taken along the line 6B-6B of FIG. 6A. FIG. 7A is a plan view illustrating another modification of the spacer member in this embodiment, and FIG. 7B is a cross-sectional view taken along the line 7B-7B of FIG. 7A.

In the modifications illustrated in FIGS. 6A and 6B and FIGS. 7A and 7B, the spacer member 90 has a front end portion 94 extending along the linker member 85 so as to sandwich the liquid introducing section 80 from the opposite sides in the transverse direction. The upper surface 91*a* and the lower surface 91*b* of the spacer member 90 at the front end portion 94 are symmetrical to each other with respect to the reference plane P2 in the modification illustrated in FIGS. 6A and 6B, as in the above embodiment, but are symmetrical to each other with respect to the center axis X of the supply port 52*a* in the modification illustrated in FIGS. 7A and 7B. Moreover, in both modifications, the upper surface 91*a* and the lower surface 91*b* at the front end portion 94 are each formed of inclined surfaces formed such that at least one of the thickness (the length in the vertical direction) and the width (the length in the transverse direction) of the spacer member 90 decreases from the rear side toward the front side. By providing such a front end portion 94, the process of shrinkage of the bag member 60 with consumption of the liquid can be controlled on the entirety of the bag member 60. This makes it possible to supply the liquid at a more uniform concentration to the liquid ejection apparatus 11 until the end.

Second Embodiment

Figure 8A:
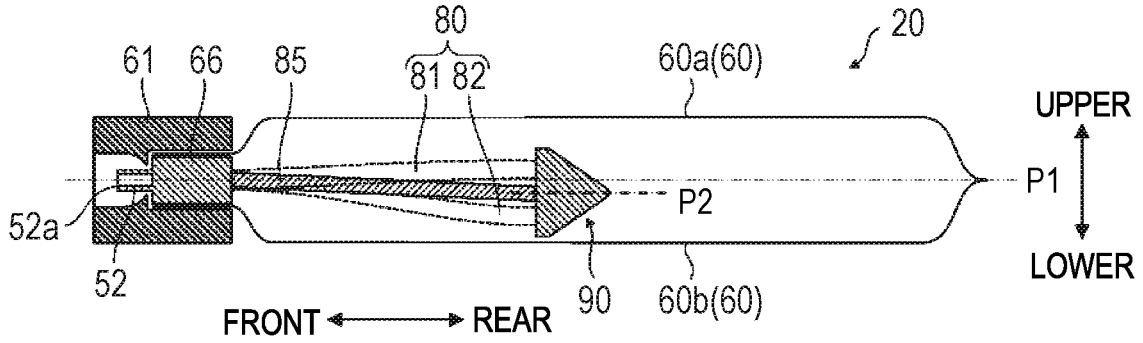
FIGS. 8A and 8B are a cross-sectional view and a front view of a liquid storage pack according to a second embodiment.
Figure 8B:
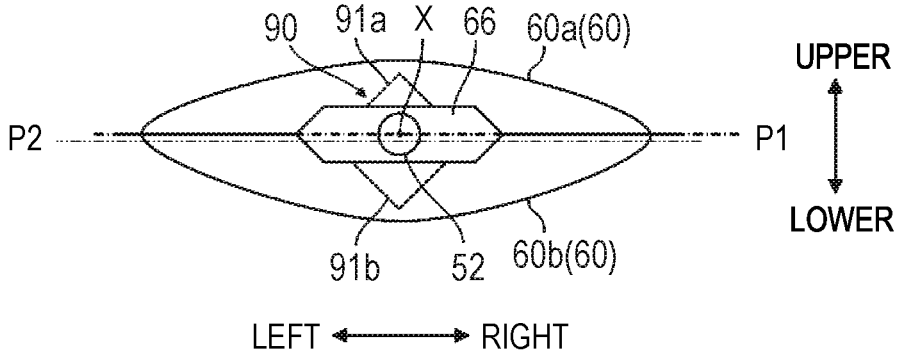

FIG. 8A is a cross-sectional view of a liquid storage pack according to a second embodiment of the present invention, corresponding to FIG. 3A. FIG. 8B is a front view of the bag member in this embodiment as seen from the front side. Note that, as in FIGS. 3A and 3B, FIGS. 8A and 8B also illustrate a state where the bag member 60 is fully filled with the liquid before the liquid storage pack 20 is used.

In this embodiment, the configurations of the flow path forming member 66 and the linker member 85 differ from those in the first embodiment. Specifically, the flow path forming member 66 is formed to be symmetrical with respect to the center axis X of the supply port 52*a*, and is joined to the bag member 60 such that the center axis X is located on the center plane P1 of the bag member 60. For this reason, while the linker member 85 extends along the center axis X of the supply port 52*a* of the flow path forming member 66 in the first embodiment, the linker member 85 extends obliquely with respect to the center axis X of the supply port 52*a* of the flow path forming member 66 in this embodiment. Thus, in this embodiment too, the reference plane P2 of the spacer member 90 can be offset downward from the center plane P1 of the bag member 60. Hence, an advantageous effect similar to that in the first embodiment can be achieved. Note that the other configurations and advantageous effects in this embodiment are similar to those in the first embodiment, and changes applicable to the first embodiment are similarly applicable to this embodiment as well. Thus, in this embodiment too, for example, the linker member 85 and the liquid introducing section 80 may be omitted and the spacer member 90 may be directly fixed to the flow path forming member 66.

According to the present invention, it is possible to stably supply a liquid at a uniform concentration regardless of the remaining amount of the liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-033479, filed Feb. 28, 2020, which is hereby incorporated by reference herein in its entirety.

What is claimed is:

1. A liquid storage pack comprising:

a flat flexible bag member storing a liquid to be supplied to a liquid ejection apparatus;

a flow path forming member that is joined to the bag member between two films forming the bag member, the flow path forming member having a supply port for supplying the liquid to the liquid ejection apparatus and a flow path communicating with the supply port; and a spacer member provided inside the bag member and extended by a linker member from the flow path forming member to a central portion of the bag member, the spacer member being linked to and supported by the flow path member via the linker member, wherein in a state where the bag member is mounted in the liquid ejection apparatus and is fully filled with the liquid, the spacer member is extended by the linker member to the central portion of the bag member and a center plane of the bag member is defined at the central portion of the bag member, the center plane passing a center of the bag member in a thickness direction thereof and being perpendicular to the thickness direction, wherein the spacer member has an outer shape that is symmetrical with respect to a predetermined reference plane, and is disposed such that the reference plane is offset downwardly from the center plane of the bag member in the thickness direction of the bag member, and wherein the flow path forming member is asymmetrical in the thickness direction of the bag member such that the supply port is offset downwardly in the thickness direction of the bag member, and wherein in the state where the bag member is mounted in the liquid ejection apparatus and is fully filled with the liquid, the reference plane passes through a center of a combined structure constituted of the flow path forming member, the linker member, and the spacer member.

2. The liquid storage pack according to claim 1, wherein the spacer member is not in contact with an inner surface of the bag member which the spacer member faces in the direction in which the spacer member is offset.

3. The liquid storage pack according to claim 1, wherein in the spacer member, two liquid intake ports are formed which open to take in the liquid inside the bag member and communicates with the flow path of the flow path forming member, and the two liquid intake ports include a first liquid intake port located on an opposite side of the center plane from the reference plane and a second liquid intake port located on an opposite side of the reference plane from the center plane.

4. The liquid storage pack according to claim 3, wherein the second liquid intake port has an aperture diameter larger than that of the first liquid intake port.

5. The liquid storage pack according to claim 4, further comprising:

a liquid introducing section provided between the flow path forming member and the spacer member and communicating with the flow path of the flow path forming member and the two liquid intake ports of the spacer member, wherein the linker member is rod-shaped.

6. The liquid storage pack according to claim 5, wherein the spacer member has a portion extending toward the flow path forming member along the linker member so as to sandwich the liquid introducing section from opposite sides.

7. The liquid storage pack according to claim 1, wherein the spacer member is fixed to the flow path forming member via the linker member.

8. The liquid storage pack according to claim 1, wherein the liquid storage pack is housed in a cuboidal case opening at a top thereof such that the liquid storage pack faces a bottom surface of the case in the direction in which the spacer member is offset.

9. A liquid storage pack comprising:

a flat flexible bag member storing a liquid to be supplied to a liquid ejection apparatus;

a flow path forming member that is joined to the bag member between two films forming the bag member, the flow path forming member having a supply port for supplying the liquid to the liquid ejection apparatus and a flow path communicating with the supply port; and a spacer member provided inside the bag member and extended by a linker member from the flow path forming member to a central portion of the bag member, the spacer member being linked to and supported by the flow path member via the linker member, wherein in a state where the bag member is mounted in the liquid ejection apparatus and is fully filled with the liquid, the spacer member is extended by the linker member to the central portion of the bag member and a center plane of the bag member is defined at the central portion of the bag member, the center plane passing a center of the bag member in a thickness direction thereof and being perpendicular to the thickness direction, wherein the spacer member has an outer shape that is symmetrical with respect to a predetermined reference plane, and is disposed such that the reference plane is offset downwardly from the center plane of the bag member in the thickness direction of the bag member, and wherein the flow path forming member is symmetrical in the thickness direction of the bag member such that the supply port is coincident with the center plane in the thickness direction of the bag member, and wherein in the state where the bag member is mounted in the liquid ejection apparatus and is fully filled with the liquid, the linker member extends obliquely downwardly such that the spacer member and the reference plane is offset downwardly from the center plane of the bag member.

10. The liquid storage pack according to claim 9, wherein the spacer member is not in contact with an inner surface of the bag member which the spacer member faces in the direction in which the spacer member is offset.

11. The liquid storage pack according to claim 9, wherein in the spacer member, two liquid intake ports are formed which open to take in the liquid inside the bag member and communicates with the flow path of the flow path forming member, and the two liquid intake ports include a first liquid intake port located on an opposite side of the center plane from the reference plane and a second liquid intake port located on an opposite side of the reference plane from the center plane.

12. The liquid storage pack according to claim 11, wherein the second liquid intake port has an aperture diameter larger than that of the first liquid intake port.

13. The liquid storage pack according to claim 12, further comprising:

a liquid introducing section provided between the flow path forming member and the spacer member and communicating with the flow path of the flow path forming member and the two liquid intake ports of the spacer member, wherein the linker member is rod-shaped.

14. The liquid storage pack according to claim 13, wherein the spacer member has a portion extending toward the flow path forming member along the linker member so as to sandwich the liquid introducing section from opposite sides.

15. The liquid storage pack according to claim 9, wherein the spacer member is fixed to the flow path forming member via the linker member.

16. The liquid storage pack according to claim 9, wherein the liquid storage pack is housed in a cuboidal case opening at a top thereof such that the liquid storage pack faces a bottom surface of the case in the direction in which the spacer member is offset.

* * * * *